US006444388B1

(12) United States Patent
Nagahama et al.

(10) Patent No.: US 6,444,388 B1
(45) Date of Patent: Sep. 3, 2002

(54) TONER FOR DEVELOPING ELECTROSTATIC LATENT IMAGE

(75) Inventors: Hitoshi Nagahama, Uji; Toshihiko Murakami; Katsuaki Sumida, both of Kashiba, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/902,181

(22) Filed: Jul. 10, 2001

(30) Foreign Application Priority Data

Jul. 11, 2000 (JP) ..... 2000-209832

(51) Int. Cl.[7] ..... G03G 9/087
(52) U.S. Cl. ..... 430/109.4; 430/111.4
(58) Field of Search ..... 430/108.23, 109.4, 430/111.4, 108.4

(56) References Cited

U.S. PATENT DOCUMENTS 5,147,747 A * 9/1992 Wilson et al. ..... 430/109.2

FOREIGN PATENT DOCUMENTS

JP 2000-029245 1/2000

* cited by examiner

*Primary Examiner*—John Goodrow
(74) *Attorney, Agent, or Firm*—David G. Conlin; John B. Alexander; Edwards & Angell, LLP

(57) ABSTRACT

The present invention provides a toner which does not cause problems on generation of an offensive odor and a stain on a surface of a cooling unit and which is excellent in an offset resistance, a low temperature fixability and an environmental dependency. In the toner for developing an electrostatic latent image comprising a polyester resin as a principal component which is formed by reacting dicarboxylic acids of a polybasic acid with diols of a polyhydric alcohol, dimethyl phthalate remaining in the polyester resin described above without reacting has a content of 0.1 % by weight or less.

10 Claims, No Drawings

TONER FOR DEVELOPING ELECTROSTATIC LATENT IMAGE

BACKGROUND OF THE INVENTION

1. Field of the Invention

The present invention relates to a toner for an electrostatic latent image used for the electrophotography and the like.

2. Description of the Related Art

Provided as a toner binder having a good offset resistance while maintaining a low temperature fixability in Japanese Patent Application Laid-Open No. 2000-29245 is a toner binder for developing an electrostatic latent image comprising a resin having a THF-insoluble content of 2 to 60% by weight which is obtained by reacting a cross-linked polyester resin of carboxylic acids, diols and a novolak type resin with oxyalkylene ether with at least one epoxy compound selected from the group consisting of a novolak type epoxy resin and an epi-bis type epoxy resin.

The toner binder described above is excellent in an offset resistance, a low temperature fixability and an environmental dependency and has the effects that it has less change in a charging amount even under various environments and that the reactivity in producing the binder is high and can easily be controlled.

However, when carrying out a copying operation with, a copying apparatus charged with a toner using the polyester resin produced the method described above, it is possible to obtain a toner which is excellent in an offset resistance, a low temperature fixability and an environmental dependency, but there has been the problem that an offensive odor is generated when an image-forming toner on a copying paper is passed through a fixing unit. Further, there has been the problem that a surface of a cooling unit is stained in a cool-solidifying step after melting and kneading.

SUMMARY OF THE INVENTION

An object of the present invention is to provide a toner which does not bring about the problems of generation of an offensive odor and a stain on a surface of a cooling unit in a cool-solidifying step and which is excellent in an offset resistance, a low temperature fixability and an environmental dependency.

Intensive investigations repeated by the present inventors have resulted in finding that dimethyl terephthalate which is an OH terminal masking agent for dicarboxylic acids remaining in the polyester resin without reacting takes part in an offensive odor and that a content of dimethyl phthalate which causes an offensive odor has a threshold value. Further, they have found out that this dimethyl phthalate causes principally a stain on a surface of a cooling unit, and they have completed the present invention.

That is, the present invention relates to a toner for developing an electrostatic latent image comprising a polyester resin. as a principal component which is formed by reacting dicarboxylic acids of a polybasic acid with diols of a polyhydric alcohol, wherein dimethyl phthalate remaining in the polyester resin described above without reacting has a content of 0.1% by weight or less.

Further, the present invention relates to an image-forming method or an image-forming apparatus using the toner for developing an electrostatic latent image described above.

In the toner for developing an electrostatic latent image of the present invention, (1) the polyester resin described above has preferably an acid value of 15 to 33 mg KOH/g,
(2) the polyester resin described above has preferably a hydroxyl group value of 10 to 30 mg KOH/g,
(3) the polyester resin described above has preferably a glass transition temperature (Tg) of 55 to 65° C.,
(4) the polyester resin described above has preferably a 4 mm descending temperature (flow tester constant rate-heating method) of 155 to 170° C.,
(5) the polyester resin described above has preferably a number average molecular weight (Mn) of 4500 to 7000,
(6) the polyester resin described above has preferably a tetrahydrofuran (THF)-insoluble content of 20 to 40% by weight,
(7) a fluidizer particle is preferably added to the surface of the toner described above and mixed therein,
(8) the fluidizer particle is preferably added and mixed in an amount of 0.1 to 3% by weight based on the whole amount of the toner.

DESCRIPTION OF THE INVENTION

The toner for developing an electrostatic latent image of the present invention comprises a polyester resin as a principal component. The polyester resin used in the present invention is a polymer which is obtained by polycondensation of a polybasic acid with a polyhydric alcohol and which is combined through ester bonds and includes either saturated or unsaturated polymer. The kind of the polyester resin shall not specifically be restricted and includes, for example, various resins such as an unsaturated polyester resin, an alkid resin, polyethylene terephthalate, polybutylene terephthalate, polyarylate and the like, and an unsaturated polyester resin is particularly preferred.

The polybasic acid constituting the polyester resin shall not specifically be restricted, and preferably used as carboxylic acids are, for example, aliphatic dicarboxylic acids (examples: maleic acid, fumaric acid, succinic acid, adipic acid, sebacic acid, malonic acid, azelaic acid, mesaconic acid and citraconic acid), aromatic dicarboxylic acids (examples: phthalic acid, isophthalic acid and terephthalic acid), alkyl or alkenyl succinates (examples: dodecenyl succinate, pentadodecenyl succinate and the like), anhydrides and lower alkyl esters of these dicarboxylic acids. More preferred are maleic acid, fumaric acid, isophthalic acid, terephthalic acid, dimethyl terephthalate and dodecenyl succinate.

The polyhydric alcohol shall not specifically be restricted, and the diols include, for example, various ones such as alkylene glycols (examples: ethylene glycol, 1,2-propylene glycol, 1,3-propylene glycol, 1,3-butanediol, 1,4-butanediol, neopentyl glycol, 1,6-hexanediol, 1,5-pentanediol and 1,6-pentanediol), alkylene ether glycols (examples: diethylene glycol, triethylene glycol, dipropylene glycol and polyethylene glycol), alicyclic diols (examples: hydrogenated bisphenol A and the like) and bisphenols (examples: bisphenol A, bisphenol F, bisphenol S and the like). The kinds of these polybasic acids and polyhydric alcohols may be either one kind or two or more kinds respectively.

The polyester resin used in the present invention has preferably an acid value of 15 to 33 mg KOH/g (based on JIS K0070-1966) and a hydroxyl group value of 10 to 30 mg KOH/g (based on JIS K0070-1916). In this case, the acid value is an index for the number of residual carboxyl groups at the terminals of the polyester resin, and the hydroxyl group value is an index for the number of residual hydroxyl groups at the terminals of the polyester resin. The acid value can be increased by elevating a use proportion of a polybasic acid (for example, trimellitic anhydride) rather than a dibasic acid in the polyester resin, and the hydroxyl group value can be controlled by reducing terminal groups in the alcohol components. The acid value can be elevated by, for example, adding 1 to 5% of maleic anhydride and 1 to 5% of trimellitic anhydride. Further, the hydroxyl group value can be controlled in the range described above by controlling terephthalic acid in a trace amount.

A polyester resin using polybasic acid having an aromatic ring and polyhydric alcohol has a good blocking resistance and therefore is preferred. In particular, preferred is a polyester resin prepared by reacting aromatic dicarboxylic acid or carboxylic acid including a derivative thereof with diols.

The polyester resin of the present invention can be obtained usually by using the raw material components described above to carry out dehydration condensation reaction or transesterification in an organic solvent in the presence of a catalyst. In this case, the reaction temperature is, for example, 150 to 300° C.

In carrying out the reaction described above, an esterification catalyst and a transesterification catalyst, for example, magnesium acetate, zinc acetate, lead acetate and antimony trioxide can be used for the purpose of accelerating the reaction.

In the present invention, an increase in the amounts of, for example, maleic anhydride and trimellitic anhydride and use of a polyester resin having a relatively large acid value make it possible to elevate the offset resistance as well as the negative charging property. Further, use of the polyester resin having a relatively small hydroxyl group value makes it possible to control the moisture-absorbing property and elevate the charging environmental stability (that is, the charging stability can be obtained as well under high temperature and high humidity environment).

In the polyester resin of the present invention, a content of dimethyl terephthalate remaining in the resin without reacting is controlled to 0.1% or less, whereby an odor and a stain in a cooling unit are reduced. In the production process of the polyester resin, diols and dicarboxylic acids used for the principal skeleton, an alcohol cross-linking agent and an acid cross-linking agent are subjected to dehydration esterification in the presence of a catalyst to synthesize a finely cross-linked polyester. Then, dimethyl phthalate which is an OH group terminal-masking agent for dicarboxylic acids is added to control the hydroxyl group value by dealcoholization transesterification. Further, the acid cross-linking agent is added to cause acid value-providing reaction to increase the viscosity (cross-linked), whereby the polyester resin of the present invention is obtained.

If a large amount of unreacted dimethyl phthalate remains in the resin in the dealcoholization transesterification described above, almost all of them result in remaining in the toner, though a trace amount thereof sublimates in producing (dissolving and kneading) the toner because it has a sublimating property at about 200° C. Accordingly, it is considered that when the toner is charged into a copying apparatus to carry out a copying operation, dimethyl phthalate sublimates when the toner which is imagewise transferred onto a copying paper passes through a fixing unit, so that an offensive odor is produced.

Residual dimethyl terephthalate is a principal cause for bringing about a stain in the cooling unit in the cooling-solidifying step after melting and kneading in the toner production process.

In light of the defects described above, the preceding problems on an offensive odor and a stain in the cooling unit have been solved in the present invention by accelerating the reaction in the dealcoholization transesterification until dimethyl terephthalate remaining in the polyester resin is controlled to 0.1% by weight or less. To be specific, a measuring equipment such as a gas chromatography which is usually available in the market is used to draw out the polyester resin in the reaction and determine a residual amount of dimethyl terephthalate, whereby the reaction can readily be controlled.

Further, the polyester resin of the present invention has preferably a glass transition temperature (Tg) of 55 to 65° C. (based on ASTM D 3418-82). The Tg controlled to this range makes it possible to elevate the blocking resistance and/or the offset resistance.

The polyester resin of the present invention has preferably a 4 mm descending temperature (flow tester constant rate-heating method; 6° C./min, load: 20 kg, die 1 mm×0.5 mmϕ, apparatus: CFT500 manufactured by Shimadzu Co., Ltd.) of 155 to 170° C. The 4 mm descending temperature controlled to this range makes it possible to elevate the fixability and/or the offset resistance.

The polyester resin of the present invention has preferably a number average molecular weight (Mn) of 4500 to 7000 (gel permeation chromatography (GPC) measuring method; column: TSK gel GMH6, measuring temperature: 25° C., sample: a THF solution of 0.5 wt %, charging amount: 200 μl, equipment: HLC-802A manufactured by TOSOH Co., Ltd.). The number average molecular weight (Mn) controlled to this range makes it possible to elevate the fixability and/or the offset resistance.

The polyester resin of the present invention has preferably a tetrahydrofuran (THF)-insoluble content of 20 to 40% by weight. In this case, the THF-insoluble content can be determined from a calculating equation of B/A×100%, wherein 100 mg (A) of a binder resin is precisely weighed and dissolved in 50 ml of THF; then, the solution is filtered under reduced pressure through a commercial membrane filter having a sieve opening of 0.1 μm; and a filtered matter is dried to obtain a dried matter (B). The value of the THF-insoluble content controlled to this range makes it possible to elevate the fixability and/or the offset resistance.

The antistatic agent in the toner of the present invention shall not specifically be restricted, and the preferred compound includes, for example, a chromium complex compound represented by the following formula:

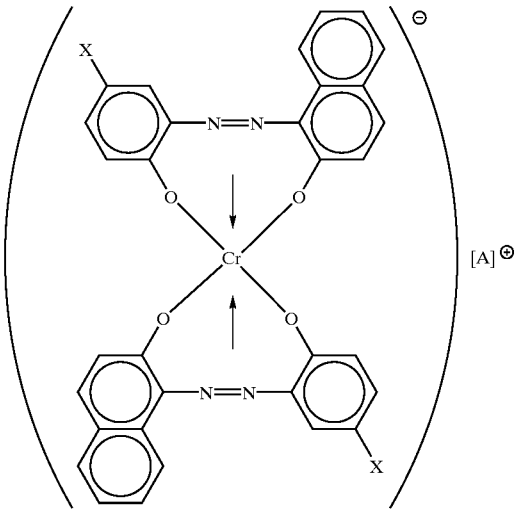

wherein X represents a chlorine atom, a bromine atom, a $SO_2NH_2$ group, a $SO_2CH_3$ group or a $SO_2C_2H_5$ group; and $A^+$ represents linear or branched alkylammonium having 8 to 16 carbon atoms which may be interposed with one hetero atom.

In this case, the ⌈hetero atom⌋ includes, for example, a nitrogen atom, an oxygen atom and a sulfur atom, and an oxygen atom is particularly preferred.

Also, the ⌈linear alkylammonium having 8 to 16 carbon atoms⌋ includes, for example, $NH_3C_{12}H_{25}^+$ and $NH_3C_{14}H_{29}^+$.

Further, the ⌈branched linear alkylammonium having 8 to 16 carbon atoms which may be interposed with one hetero atom⌋ includes, for example, $NH_3C_3H_6OC(C_2H_5)HC_4H_9^+$ and $NH_3C_3OCH_2C(C_2H_5)HC_4H_9^+$.

In the toner for developing an electrostatic latent image of the present invention, the polyester resin is added preferably in a proportion of 80 to 95% by weight, particularly preferably 85 to 90% by weight based on the whole amount of the toner. Also, the chromium complex compound is added preferably in a proportion of 0.5 to 5% by weight, particularly preferably 1 to 3% by weight based on the whole amount of the toner.

A positive charge controller can further be added to the toner for developing an electrostatic latent image of the present invention. Preferably, the positive charge controller capable of being used includes, for example, nigrosine base dyes, pyridinium salts, ammonium salts or lake compounds thereof. The positive charge controller is added preferably in a proportion of 0.05 to 0.5% by weight, particularly preferably 0.1 to 0.3% by weight based on the whole amount of the toner.

In the toner for developing an electrostatic latent image of the present invention, silica is preferably carried on a toner surface. Silica is carried preferably in a proportion of 0.1 to 3% by weight, more preferably 0.3 to 1% by weight based on the whole amount of the toner.

A specific surface area of silica is controlled preferably to a range of 90 to 240 $m^2/g$ (BET method). The specific surface area controlled to this range prevents a fluidity of the toner from being damaged in copying. The toner is provided with a fluidity by a spacer effect, and air is preferably interposed between the toner particles. Accordingly, the specific surface area controlled to the range described above provides further higher spacer effect. In contrast with this, the specific surface area which is smaller than the range described above reduces interposition of air and does not provide the satisfactory spacer effect in a certain case. The specific surface area exceeding the range described above makes it easy to cause coagulation among silica to produce free silica and exerts an adverse effect on a copied image in the form of a facula in a certain case.

The toner for developing an electrostatic latent image of the present invention may comprise, in addition to the components described above, additives such as a fixing mold-releasing agent, a colorant, a dispersant, a magnetic powder and the like which are usually used for a toner. Further, a resin other than a polyester resin may be used in combination.

The fixing mold-releasing agent includes, for example, natural waxes such as montan acid ester wax and carnauba wax, polyolefin base waxes such as high pressure method polyethylene and polypropylene, silicon base waxes and fluorine base waxes.

The colorant includes, for example, carbon black, a magnetic powder, organic dyes of a nitro base, a stilbeneazo base, a diphenylmethane base, a triphenylmethane base, a methine base, a thiazole base, an anthraquinone base, an imidamine base, an oxazine base, a thiazine base, a sulfide dye base, an indigoid base and a phthalocyanine base, and pigments.

The dispersant includes, for example, metallic soap and polyethylene glycol.

The magnetic powder includes, for example, metals such as iron, cobalt, nickel, chromium and manganese or alloys thereof and metal oxides such as chromium dioxide, diiron trioxide and ferrite.

The resin includes, for example, styrene resins, styrene-acryl copolymer resins, styrene-acrylonitrile copolymer resins, acryl resins, styrene-maleic anhydride copolymer resins, styrene-acryl-maleic anhydride copolymer resins, polyvinyl chloride resins, polyvinyl acetate resins, polyolefin resins, polyurethane resins, urethane-modified polyester resins and epoxy resins.

The toner for developing an electrostatic latent image of the present invention can be produced by publicly known methods. The components described above are mixed, for example, by means of a mixable apparatus such as a Hoenschel mixer a super mixer, a mechano mill and an air mixer including a Q type mixer, and the mixture is molten and kneaded at a temperature of 70 to 180° C. by means of an apparatus such as a two shaft kneader and a single shaft kneader. The resulting kneaded matter is cooled and solidified, and the solidified matter is pulverized by means of an air type crusher such as a jet mill, whereby the toner can be produced. The matter is pulverized preferably so that the toner has a particle diameter controlled to 5 to 25 $\mu$m, more preferably 7 to 15 $\mu$m.

EXAMPLES

Next, the present invention shall be explained in further details with reference to examples, but the present invention shall not be restricted by them.

Example 1

| Components | Blending amount |
|---|---|
| Polyester resin 1 (Mn 5400 manufactured by Sanyo Chemical Ind. Co., Ltd., dimethyl phthalate content: 0.01% by weight, acid value: 26, hydroxyl group value: 29) | 100 parts by weight |
| Negative charge controller (Aizen Spilon Black TRH manufactured by Hodogaya Chemical Ind. Co., Ltd.) | 1.5 part by weight |
| Positive charge controller (Bontron N09 manufactured by Orient Chemical Co., Ltd.) | 0.2 part by weight |
| Carbon black (MA-77 manufactured by Mitsubishi Chemical Co., Ltd.) | 5 parts by weight |
| Polypropylene (Viscol 550P manufactured by Sanyo Chemical Ind. Co., Ltd. | 2 parts by weight |

The components described above were mixed and molten and kneaded by means of a two shaft extruding machine, and then the kneaded matter was cooled and crushed to obtain a toner of 8 $\mu$m. Added to the toner was 0.5 part by weight of fluidizer particle silica (Aerosil R976S manufactured by Nippon Aerosil Co., Ltd., specific surface area: 110) to obtain the toner of the present invention.

Example 2

| Components | Blending amount |
|---|---|
| Polyester resin 2 (Mn 5600 manufactured by Sanyo Chemical Ind. Co., Ltd., dimethyl phthalate content: 0.05% by weight, acid value: 25, hydroxyl group value: 16) | 100 parts by weight |
| Positive charge controller (Bontron N04 manufactured by Orient Chemical Co., Ltd.) | 0.2 part by weight |
| Fluidizing agent particle (Aerosil R974 manufactured by Nippon Aerosil Co., Ltd., specific surface area: 170) | 0.5 part by weight |

The toner of the present invention was obtained in the same manner as in Example 1, except that the compounds described above were used as the polyester resin, the positive charge controller and the fluidizer particle.

Example 3

| Components | Blending amount |
|---|---|
| Polyester resin 3 (Mn 4500 manufactured by Sanyo Chemical Ind. Co., Ltd., dimethyl phthalate content: 0.09% by weight, acid value: 15, hydroxyl group value: 15) | 100 parts by weight |
| Positive charge controller (Bontron P51 manufactured by Orient Chemical Co., Ltd.) | 0.2 part by weight |
| Fluidizer particle (Aerosil R812S manufactured by Nippon Aerosil Co., Ltd., specific surface area: 220) | 0.3 part by weight |

The toner of the present invention was obtained in the same manner as in Example 1, except that the compounds described above were used as the polyester resin, the positive charge controller and the fluidizer particle.

Example 4

| Components | Blending amount |
|---|---|
| Polyester resin 4 (Mn 6800 manufactured by Sanyo Chemical Ind. Co., Ltd., dimethyl phthalate content: 0.10% by weight, acid value: 33, hydroxyl group value: 11) | 100 parts by weight |
| Fluidizer particle (Wacker HDK H3004 manufactured by Wacker Co., Ltd., specific surface area: 200) | 0.7 part by weight |

The toner of the present invention was obtained in the same manner as in Example 1, except that the compounds described above were used as the polyester resin and the fluidizer particle.

Comparative Example 1

| Components | Blending amount |
|---|---|
| Polyester resin 5 (Mn 5200 manufactured by Sanyo Chemical Ind. Co., Ltd., dimethyl phthalate content: 0.17% by weight, acid value: 24, hydroxyl group value: 17) | 100 parts by weight |
| Positive charge controller (Bontron N09 manufactured by Orient Chemical Co., Ltd.) | 0.2 part by weight |
| Fluidizing agent particle (Aerosil RX50 manufactured by Nippon Aerosil Co., Ltd., specific surface area: 50) | 4.0 part by weights |

A comparative toner was obtained in the same manner as in Example 1, except that the compounds described above were used as the polyester resin, the positive charge controller and the fluidizer particle.

Comparative Example 2

| Components | Blending amount |
|---|---|
| Polyester resin 6 (Mn 5900 manufactured by Sanyo Chemical Ind. Co., Ltd., dimethyl phthalate content: 0.15% by weight, acid value: 27, hydroxyl group value: 13) | 100 parts by weight |
| Positive charge controller (Bontron N04 manufactured by Orient Chemical Co., Ltd.) | 0.2 part by weight |
| Fluidizer particle (Aerosil 300 manufactured by Nippon Aerosil Co., Ltd., specific surface area: 300) | 0.1 part by weight |

A comparative toner was obtained in the same manner as in Example 1, except that the compounds described above were used as the polyester resin, the positive charge controller and the fluidizer particle.

Comparative Example 3

| Components | Blending amount |
|---|---|
| Polyester resin 7 (Mn 4700 manufactured by Sanyo Chemical Ind. Co., Ltd., dimethyl phthalate content: 0.13% by weight, acid value: 15, hydroxyl group value: 14) | 100 parts by weight |
| Positive charge controller (Bontron P51 manufactured by Orient Chemical Co., Ltd.) | 0.2 part by weight |
| Fluidizer particle (Aerosil R812 manufactured by Nippon Aerosil Co., Ltd., specific surface area: 260) | 0.3 part by weight |

A comparative toner was obtained in the same manner as in Example 1, except that the compounds described above were used as the polyester resin, the positive charge controller and the fluidizer particle.

Comparative Example 4

| Components | Blending amount |
|---|---|
| Polyester resin 8 (Mn 6700 manufactured by Sanyo Chemical Ind. Co., Ltd., dimethyl phthalate content: 0.12% by weight, acid value: 33, hydroxyl group value: 10) | 100 parts by weight |
| Positive charge controller (Bontron N09 manufactured by Orient Chemical Co., Ltd.) | 0.2 part by weight |
| Fluidizer particle (Wacker HDK H3004 manufactured by Wacker Co., Ltd., specific surface area: 220) | 0.3 part by weight |

A comparative toner was obtained in the same manner as in Example 1, except that the compounds described above were used as the polyester resin, the positive charge controller and the fluidizer particle.

Test Examples

Tests of the following items 1 to 5 were carried out for the toners obtained in the examples and comparative examples described above. The results thereof are shown in Table 1.

1. Odor Evaluation After Fixing

A copying machine AR-405 manufactured by Sharp Co., Ltd. was used to carry out a copying test under environment of an ordinary temperature and an ordinary humidity (20° C., 65%) to evaluate an odor based on the following criteria. That is, solid black was copied to carry out an odor functional test of the toner on a copied image immediately after discharged from a fixing unit. Necosa paper of 8.5 inch×11 inch, 75 g/m$^2$: SHARP Copy Bond SF-70NA manufactured by SHARP ELECTRONICS CORPORATION was used for a copying paper.

<Evaluation Criteria>

| | | |
|---|---|---|
| Odor: | little detected | ○ |
| | a little detected | Δ |
| | detected | X |

2. Stain Evaluation in Cooling Unit in Toner Production Process

A stain state in the cooling unit was visually observed on the conditions of a cooling speed of 100 kg/hr in the toner and a toner amount of 50 kg passing through the cooling part.

<Evaluation Criteria>

| | | |
|---|---|---|
| Stain in cooling unit: | little observed | ○ |
| | a little observed | Δ |
| | observed | X |

3. Evaluation of Image Density and Blowoff Charging amount (Q/M)

A digital copying machine AR-405 manufactured by Sharp Co., Ltd. was used to carry out a copying test under environment of a high temperature and a high humidity (35° C., 85%) to evaluate them. Necosa paper of 8.5 inch×11 inch, 75 g/m$^2$ was used for a copying paper.

3-1. Image density: through the copying test (6% original used) of 80,000 sheets, 1.35 or more was rated as ○, and less than 1.35 was rated as X. Measuring equipment: Process Measurements RD914 type manufactured by Macbeth Co., Ltd.

3-2. Q/M: through the copying test (6% original used) of 80,000 sheets, a developer was sampled from a developing unit and measured. Measuring equipment: blowoff powder charge measuring equipment TB-200 manufactured by Toshiba Chemical Co., Ltd.

4. Evaluation of Fixing Offset Resistance

A digital copying machine AR-405 in which a fixing part was remodeled to a temperature variable type manufactured by Sharp Co., Ltd. was used to carry out a copying test to evaluate it. Necosa paper of 8.5 inch×11 inch, 75 g/m$^2$ was used for a copying paper.

<Evaluation Criteria>

Offset-Generating Temperature at Low Temperature Side

140° C. or lower was rated as ○

Offset-Generating Temperature at High Temperature Side

220° C. or higher was rated as ○

5. Overall Evaluation

Overall evaluation was carried out based on the following criteria.

<Evaluation Criteria>

Overall Evaluation

| | |
|---|---|
| all evaluation items are rated as ○ | ○ |
| at least one item is rated as Δ | Δ |
| at least one item is rated as X | X |

TABLE 1

| | Odor after fixing | Stain in cooling unit | Copying at high temperature and high humidity: Image density | | Blowoff charging amount Q/M (μC/g) | Fixing off set resistance heat-generating temperature (° C.): Low temperature side/ high temperature side | | Overall evaluation |
|---|---|---|---|---|---|---|---|---|
| Example 1 | ○ | ○ | 1.40 to 1.45 | ○ | 20 to 25 | 130/230 | ○ | ○ |
| Example 2 | ○ | ○ | 1.40 to 1.43 | ○ | 25 to 30 | 125/225 | ○ | ○ |
| Example 3 | ○ | ○ | 1.37 to 1.40 | ○ | 32 to 37 | 115/225 | ○ | ○ |
| Example 4 | ○ | ○ | 1.48 to 1.50 | ○ | 17 to 22 | 140/250 | ○ | ○ |
| Comparative Example 1 | X | X | 1.40 to 1.45 | ○ | 15 to 20 | 120/240 | ○ | X |
| Comparative Example 2 | X | X | 1.40 to 1.43 | ○ | 25 to 30 | 125/225 | ○ | X |
| Comparative Example 3 | Δ | Δ | 1.37 to 1.40 | ○ | 32 to 37 | 115/225 | ○ | Δ |
| Comparative Example 4 | Δ | Δ | 1.49 to 1.52 | ○ | 16 to 21 | 140/250 | ○ | Δ |

The toner of the present invention is reduced in dimethyl terephthalate remaining in the polyester resin without reacting, so that the problems on generation of an offensive odor and a stain on a surface of a cooling unit in a cooling and solidifying step are not caused, and the toner is excellent in an offset resistance, a low temperature fixability and an environmental dependency.

What is claimed is:

1. A toner for developing an electrostatic latent image comprising a polyester resin as a principal component which is formed by reacting dicarboxylic acids of a polybasic acid with diols of a polyhydric alcohol, wherein dimethyl phthalate remaining in the polyester resin described above without reaching has a content of 0.1% by weight or less, and wherein said polyester resin has a hydroxyl group value of 10 to 30 mg KOH/g.

2. The toner for developing an electrostatic latent image as described in claim 1, wherein said polyester resin has an acid value of 15 to 33 mg KOH/g.

3. The toner for developing an electrostatic latent image as described in claim 1, wherein said polyester resin has a glass transition temperature (Tg) of 55 to 65° C.

4. The toner for developing an electrostatic latent image as described in claim 1, wherein said polyester resin has a 4 mm descending temperature (flow tester constant rate-heating method) of 155 to 170° C.

5. The toner for developing an electrostatic latent image as described in claim 1, wherein said polyester resin has a number average molecular weight (Mn) of 4500 to 7000.

6. The toner for developing an electrostatic latent image as described in claim 1, wherein said polyester resin has a tetrahydrofuran (THF)-insoluble content of 20 to 40% by weight.

7. The toner for developing an electrostatic latent image as described in claim 1, wherein a fluidizer particle is add to the surface of the toner described above and mixed therein.

8. The toner for developing an electrostatic latent image as described in claim 7, wherein the fluidizer particle is added and mixed in an amount of 0.1 to 3% by weight based on the whole amount of the toner.

9. An image-forming method using the toner for developing an electrostatic latent image as described in claim 1.

10. An image-forming apparatus using the toner for developing an electrostatic latent image as described in claim 1.

* * * * *